United States Patent [19]

Wakayama et al.

[11] 4,379,248

[45] Apr. 5, 1983

[54] IONIZATION CHAMBER HAVING COAXIALLY ARRANGED CYLINDRICAL ELECTRODES

[75] Inventors: Naoki Wakayama, Tohkaimura; Hideshi Yamagishi, Mito; Toshimasa Tomoda; Hiroji Tanaka, both of Amagasaki, all of Japan

[73] Assignees: Mitsubishi Denki Kabushiki Kaisha; Japan Atomic Energy Research Institute, both of Tokyo, Japan

[21] Appl. No.: 36,236

[22] Filed: May 4, 1979

[30] Foreign Application Priority Data

May 4, 1978 [JP] Japan ..... 53-53570

[51] Int. Cl.[3] ..... H01J 47/02; H01J 1/92; H01J 17/04

[52] U.S. Cl. ..... 313/93; 313/30; 313/147

[58] Field of Search ..... 313/93, 61 D, 247, 147, 313/30; 250/390

[56] References Cited

U.S. PATENT DOCUMENTS

| | | | |
|---|---|---|---|
| 2,440,167 | 4/1948 | Broxon et al. | 313/93 X |
| 2,976,443 | 3/1961 | Johnson | 313/93 X |
| 3,043,954 | 7/1962 | Boyd et al. | 313/93 X |
| 3,075,116 | 1/1963 | Connor | 313/93 |
| 3,091,716 | 5/1963 | Engelmann | 313/147 X |
| 3,382,390 | 5/1968 | Chameroy et al. | 313/93 X |
| 4,044,301 | 8/1977 | Allain et al. | 313/61 R |

*Primary Examiner*—Palmer C. Demeo

*Attorney, Agent, or Firm*—Oblon, Fisher, Spivak, McClelland & Maier

[57] ABSTRACT

An ionization chamber comprises a plurality of cylindrical electrodes which are coaxially arranged, and a casing which holds the cylindrical electrodes in it under the condition allowing the axial shifting of the edges of the cylindrical electrodes but preventing the radial shifting of the cylindrical electrodes whereby the slight relative deviation of parts for the ionization chamber can be minimized during use at high temperature or during a severe thermal cycle.

8 Claims, 5 Drawing Figures

IONIZATION CHAMBER HAVING COAXIALLY ARRANGED CYLINDRICAL ELECTRODES

BACKGROUND OF THE INVENTION

1. Field of the Invention

The present invention relates to an ionization chamber. More particularly, it relates to an ionization chamber which prevents slight deviations of parts caused by manufacturing error and differences due to thermal expansions of the parts for the ionization chamber.

2. Description of the Prior Art

It has been proposed to use an ionization chamber as shown in FIG. 1.

In FIG. 1, a cylindrical outer electrode (2) is coaxially arranged with a cylindrical inner electrode (1) and the outer electrode (2) is covered by an outer casing (3). A disc bottom plate or first edge plate, (4) is mounted at one end of the outer casing (3) by welding etc. to close the opening of the outer casing and a disc top plate (5) is mounted at the upper end of the outer casing (3) by welding etc. to close the opening of the outer casing. A holding plate or second edge plate (6), which is a disc concentric with the disc top plate (5), is fitted into the inside edge of the outer casing (3) adjacent to the top plate (5) and a shoulder (3*a*) of part (3) of the outer casing. The inner electrode (1) is electrically insulated from the holding plate (6) by ring insulators (7),(8) and it is held in the fitting structure.

On the other hand, the outer electrode (2) is electrically insulated from the bottom plate (4) by ring insulators or first and second cylindrical guides, (9), (10), respectively and it is held in the fitting structure. Cylindrical insulators (11), (12) are mounted on the holding plate (6) by means of threads. Output terminal parts (13), (14), each including a cylindrical insulator, are mounted on the top plate (5).

The inner electrode (1) and the outer electrode (2) are electrically connected to an output terminal part (13) and an output terminal part (14) through lead wires (15), (16), respectively. The lead wires (15), (16) pass through the insulators (11), (12) and the holding plate (6). Springs (17), (18) are respectively fitted between the insulators (9), (10) and the bottom plate (4). The outer casing (3), the bottom plate (4), the top plate (5), and the output terminal parts (13), (14) are bonded in an air-tight condition with each other to form an air-tight chamber. An ionizable gas fills the chamber within the sealing structure and can move among all spaces in the chamber. The bottom plate (4), the top plate (5) and the holding plate (6) are side plates for closing the openings of the outer casing (3).

The springs (17), (18) are used not only for absorbing errors of the size of the parts of the ionization chamber, but also for absorbing differences due to thermal expansions of the parts in the axial direction at high temperature.

In the preparation of the ionization chamber, the ionization chamber is assembled and heated in a vacuum to a temperature higher than its normal operating temperature for degasing the parts before filling the chamber with an ionizable gas. The springs (17), (18) should also absorb differences due to thermal expansions in the axial direction which is caused in the abovementioned step.

When the springs are heated to a high temperature, a relaxation phenomenon occurs which causes the free length of the springs to become shorter. As the result, the pushing force is decreased. Sometimes, the relaxation at high temperatures is remarkably large. When the device is cooled to a low temperature, a slight looseness of the parts may occur. For example, when the ionization chamber is heated to a high temperature and is then cooled, the ionization chamber is cooled from the outer surface to the higher temperature inner parts of the chamber resulting in large amounts of thermal expansion because it takes a certain amount of time for the thermal conduction to the inside of the ionization chamber. Therefore, the spring (17) used inside is compressed by stronger pressure than that of the temperature equilibrium condition to cause a large relaxation.

In the ionization chamber having a spring, the relaxation of the spring is caused by use at high temperatures or by thermal cycles. The pushing force of the spring is decreased. Sometimes, a looseness is caused, whereby the relative position of the two electrodes is changed by a small outer force to affect the characteristics of the ionization box. Moreover, microphonic noise is caused by shifting the electrodes, thereby disturbing the measurement of radioactive rays by the ionization chamber. These disadvantages are found in the conventional devices.

In the conventional ionization chamber, the output terminal parts (13), (14) are made by metal-ceramic sealing means.

The metal-ceramic sealing means have been widely used as a through type terminal for electric signals in order to transmit electric signals such as current and voltage or electric power through a wall of a closed casing of a vacuum device or an ionization chamber. Various kinds of structures of the sealing parts have been proposed. It is recognized that a cylindrical metal-ceramic sealing means, such as the cylindrical ceramic peripheral part bonded inside a cylindrical sealing metal shown in FIG. 2, is optimum.

In FIG. 2, a cylindrical ceramic part (131) and a cylindrical sealing metal part (132), are bonded at a bonding part (133) between the ceramic part (131) and the sealing metal part (132). The ceramic part is usually bonded to the sealing metal part by forming a metallizing layer on the surface of the ceramic part and plating it with nickel and brazing it with the sealing metal part with braze suitable for the brazing temperature.

Suitable ceramics used for this purpose include forsterite and alumina.

Suitable sealing metals are metals having thermal coefficients substantially similar to that of ceramic and include nickel, iron, cobalt alloy and iron-nickel alloy.

The metal-ceramic sealing terminals and the sealing means which can be satisfactorily used at a temperature ranging from room temperature to about 400° C. have been commercially available.

However, it has been required to use a metal-ceramic sealing terminal which is durable at 700° C. to 750° C., in a high temperature ionization chamber or a high temperature vacuum casing. It has been difficult to maintain the seal with safety at such high temperature by the conventional technology.

A pressurized gas at higher than 3 atm. is used as an ionizable gas in many cases. At high temperature, the metal-ceramic sealing terminal is sometimes broken thereby causing faults. Efforts have been made for improving the strength of the metal-ceramic sealing terminal at high temperature. However, it has been difficult to conform the thermal expansion of the metal (131)

with that of the ceramic (132) in the metal-ceramic sealing terminal at wide range of temperature. When the thickness of the sealing metal is increased to increase the high temperature durability and to increase the strength of the sealing metal, the stress at the bonding part caused by the difference of thermal expansions of the ceramic is increased so as to peel off the bonding part.

The sealing metal special alloy has a Curie point, and the thermal expansion coefficient at temperatures higher than the Curie point is highly different from temperatures lower than the Curie point. On the other hand, the thermal expansion coefficient of the ceramic gradually varies depending upon the temperature. It is impossible to conform the thermal expansions of the sealing metal and the ceramic over wide temperature ranges. A peeling-off of the bonding part and the crackings of the sealing metal are caused by applying thermal cycles thereby causing leakage.

SUMMARY OF THE INVENTION

In accordance with the present invention, one object is to provide an ionization chamber in which a plurality of coaxially arranged cylindrical electrodes are held in a casing containing an ionizable gas so as to allow axial shifting of the edges of the cylindrical electrodes but to prevent radial shifting of the cylindrical electrodes, whereby the ionization chamber can be used at a high temperature without suffering deviation of the parts caused by thermal cycles and a resultant deterioration of the characteristics of the ionization chamber.

Another object of the present invention is to provide an ionization chamber in which a plurality of coaxially arranged cylindrical electrodes are held in a casing containing an ionizable gas so as to allow axial shifting of the edges of the cylindrical electrodes but to prevent radial shifting of the cylindrical electrodes; and to provide a cylindrical metal-ceramic sealing means which is sealed with metal on the outer peripheral surface and which is used as a terminal for transmitting electric signals out of the ionization chamber; and to provide a taper for gradually thinning the thickness of the cylindrical metal to the end which is is formed at the outer peripheral part whereby the disadvantageous thermal effects to the cylindrical electrode are decreased to improve heat durability of the terminal.

Still another object of the present invention is to provide an ionization chamber which comprises two casings and a plurality of coaxially arranged cylindrical electrodes which are held in the first casing so as to allow axial shifting of the edges of the cylindrical elecrodes but to prevent radial shifting of the cylindrical electrodes. A sealing terminal for transmitting electric signals through the first casing is held in the second casing having substantially the same pressure as that of the first casing whereby disadvantageous thermal effects to the cylindrical electrodes is minimized to maintain a closed condition at high temperatures without the need of high pressure durability of the sealing terminal.

BRIEF DESCRIPTION OF THE DRAWINGS

FIG. 2(*b*) is a sectional view taken along the B—B line of FIG. 2(*a*);

FIG. 4(*b*) is a sectional view taken along the B—B line of FIG. 4(*a*);

DETAILED DESCRIPTION OF THE INVENTION

Figure 1:
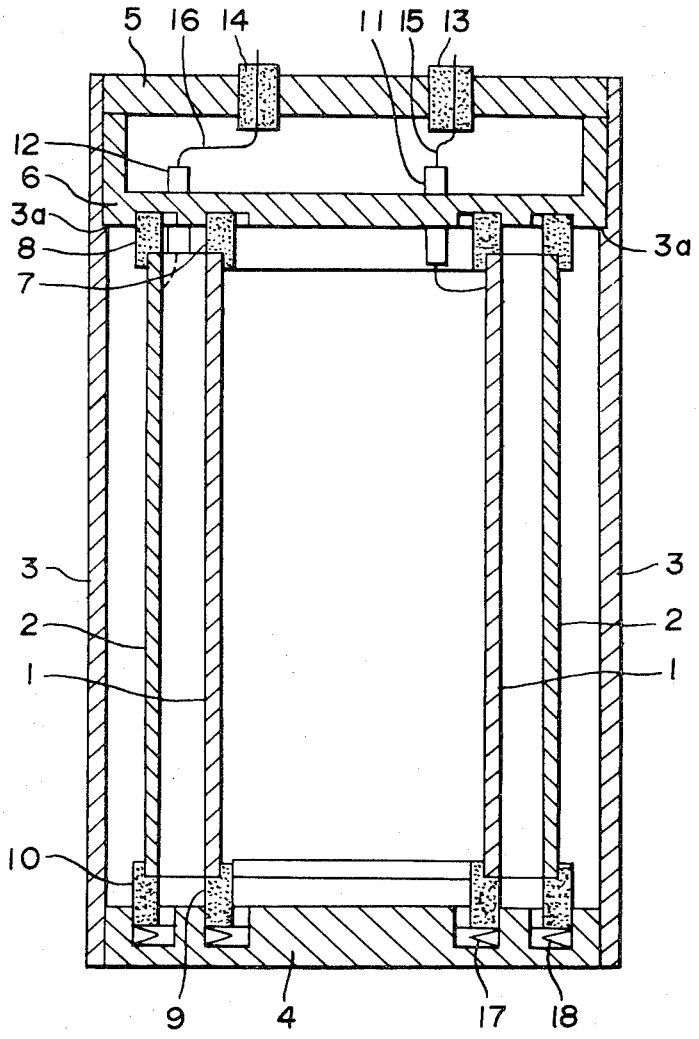
FIG. 1 PRIOR ART
FIG. 1 is a schematic sectional view of the conventional ionization chamber.
Figure 3:
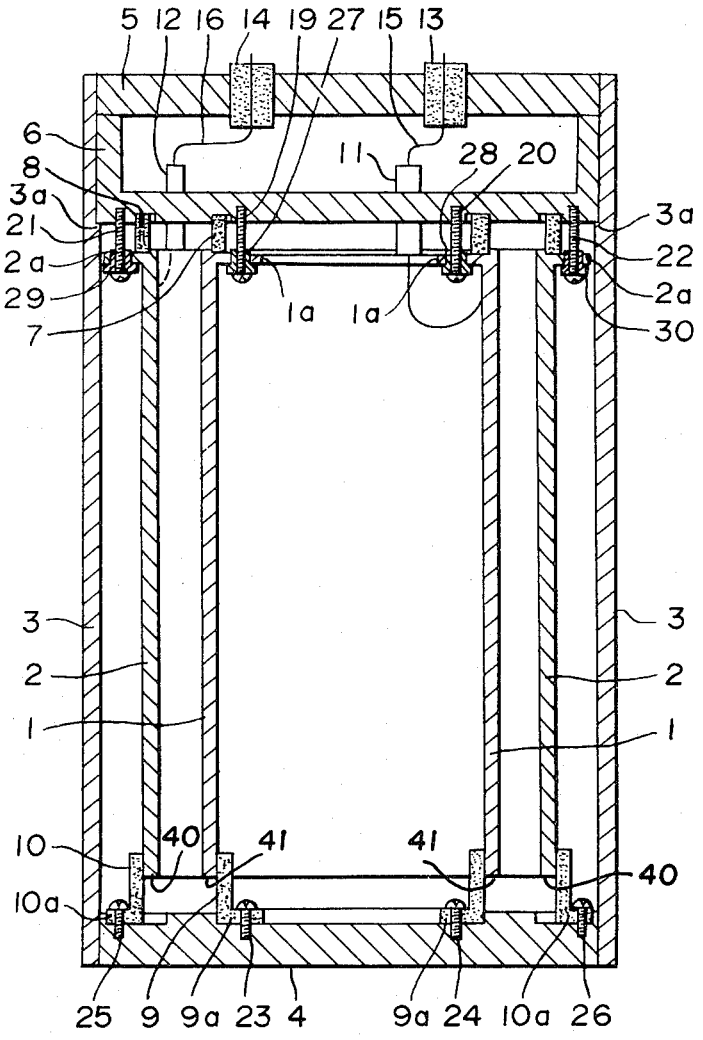
FIG. 3 is a schematic sectional view of one embodiment of the ionization chamber of the present invention.

In FIG. 3, the same reference numerals designate identical or corresponding parts as shown in FIG. 1. The description of these reference numerals is not repeated.

In the embodiment of FIG. 3, annular collars or first and second integral collars (1*a*), (2*a*) are respectively formed in one body or integrally on the edges of cylindrical inner electrode (1) and the cylindrical outer electrode (2) at the side of a holding plate (6). A plurality of small holes are formed in the collars (1*a*) (2*a*), respectively.

Annular collars (9*a*), (10*a*) having a plurality of small holes are respectively formed in one body on the insulators (9), (10) which guide the electrodes (1), (2) so as to axially shift the other edge or axial end surface portions 40,41 of the electrodes and control the radial shifting.

The inner electrode (1) is fixed on the holding plate (6) through the small holes in the collar (1*a*) by screws (19), (20) in the axial direction. On the other hand, the outer electrode (2) is fixed on the holding plate (6) through the small holes in the collar (2*a*) by screws (21), (22) so as to be axially suspended. The insulator (9) is fixed on the bottom plate (4) through small holes in the collar (9*a*) by the screws (23), (24) in the axial direction. The insulator (10) is fixed on the bottom plate (4) through small holes in the collar (10*a*) by the screws (25), (26) in the axial direction.

The screws (19), (20) are electrically insulated from the inner electrode (1) by the insulators (27), (28). The screws (21),(22) are electrically insulated from the outer electrode (2) by the insulators (29), (30).

When radioactive rays irradiate the chamber, the gas in the space between the inner electrode (1) and the outer electrode (2) is ionized. When a DC voltage is applied between the electrode (1) and the electrode (2), the ionized electrons and ions are collected by the electrodes depending upon their polarities whereby electrical signals are produced in the electrodes. The electric signals are detected through the output terminals (13), (14).

The electrodes (1), (2), having the structures shown in FIG. 3, are fixed to the holding plate (6) at one edge. The other edges of the electrodes are held so as to control radial shifting. Even though thermal expansion differences occur between the electrodes (1), (2) and the insulator (9) free sliding in the axial direction results between the inner electrode (1) and the insulator (9) and between the outer electrode (2) and the insulator (10) to absorb the difference whereby stresses in the axial direction is not caused in these parts. The electrodes (1), (2) are held at both of their edges in the radial direction, whereby relative shifting of the electrodes does not substantially occur. The effect of the thermal expansion on the characteristics of the ionization chamber is small.

In the embodiment of FIG. 3, the edges of the electrodes (1), (2) are fixed to the holding plate (6) as the edge plate. It is possible to include a feature wherein a central part of the outer electrode (2) in the longitudinal direction is radially fixed to an outer cylinder and both of the edges of the outer electrode (2) are held by insulators (9) which guide the electrodes in the axial direction and prevent the radial shifting.

In said modified feature, the outer cylinder (3) is different from the outer electrode (2). However, the same effect can be attained when this inner electrode (1) has the structure of the embodiment even though the outer cylinder is the outer electrode (2).

The output terminals (13), (14) of the ionization chamber of FIG. 3 will be described (only output terminal (13) is described to simplify the description).

Figure 4A:
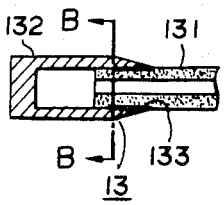
FIG. 4(*a*) is a sectional view of a sealing means of an output terminal of the ionization chamber of FIG. 3.
Figure 4B:
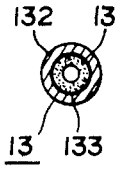

The output terminal (13) is made by a metal-ceramic sealing means. The structure is shown in FIG. 4, wherein the terminal part comprises a cylindrical sealing metal (132) whose thickness is gradually decreased in the direction of its edge and a cylindrical ceramic (131) fitting on the cylindrical sealing metal. A joint (133) has the conventional structure.

Figure 2A:
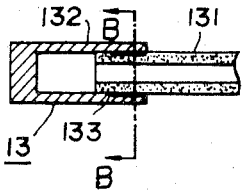
FIG. 2(*a*) is a sectional view of a sealing means of an output terminal of the conventional ionization chamber.
Figure 2B:
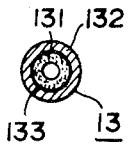

A difference between the structure of the metal-ceramic sealing means shown in FIG. 4 and the conventional one shown in FIG. 2 is the gradual thinning of the thickness of the sealing edge of the cylindrical sealing metal (132) in order to improve the heat resistance at the sealing part.

The heat resistance of the sealing part of the sealing metal (132) will be further described.

Sometimes, the outer peripheral edge of the sealing metal is slightly sheaved at about 45 degree in the processing of the sealing metal as a thread chamfering for deburring even in the conventional shape as shown in FIG. 2. In order to improve the heat resistance, the length l for decreasing the thickness of the sealing metal joint is more than 2 times of the thickness t of the sealing metal so as to produce this remarkable effect.

Figure 5A:
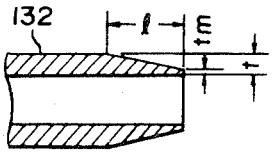
FIGS. 5(*a*), (*b*), (*c*) are respectively sectional views of various embodiments of the sealing metal used as the sealing means of the outer terminal.
Figure 5B:
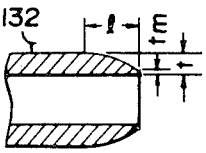
Figure 5C:
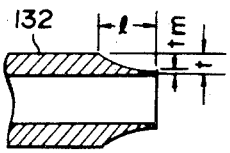

The rate of variation of the thickness can be a constant taper having a constant gradient as shown in FIG. 5(*a*) or a convex or concave variation of the thickness as shown in FIGS. 5(*b*) or 5(*c*).

The shape of FIG. 5(*b*) is suitable in the case of a relatively small thickness of the cylindrical metal. The shape of FIG. 5(*c*) is suitable in the case of relatively large thickness of the cylindrical metal. The smallest thickness of the metal tm such as the edge of FIG. 5(*a*) is preferably zero or almost zero. When such processing is difficult, it is preferable to decrease the thickness tm to less than ½ of the original thickness before processing.

The results of thermal durability tests will be described referring to FIG. 7.

Figure 6:
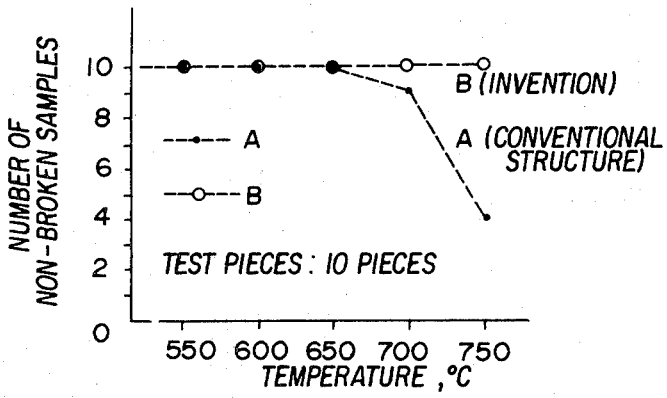
FIG. 6 is a graph of high temperature thermal cycling tests made under the same conditions for the bonding of an alumina ceramic part to a sealing metal part of nickel-cobalt-iron alloy, in the conventional sealing means (FIG. 2) or in the sealing means of the invention (FIG. 4)
Figure 7:
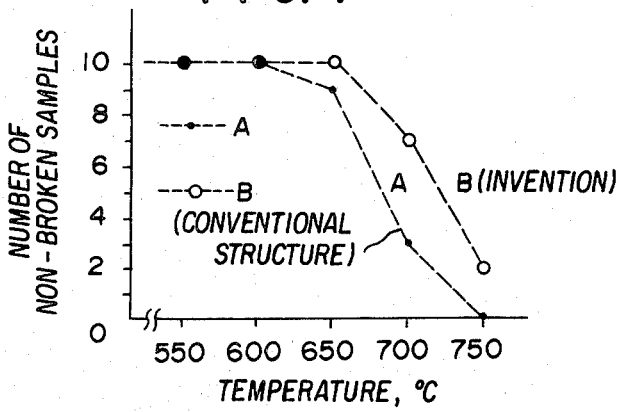
FIG. 7 is a graph of high temperature thermal cycling tests made under the same conditions for the bonding of nickel-iron alloy in the conventional sealing means (FIG. 2) or in the sealing means of the invention (FIG. 4)

FIGS. 6 and 7 show differences of heat durabilities of the sealing means of FIG. 4 and those of the conventional sealing means.

FIG. 6 shows data for a terminal made by of case bonding alumina ceramic with nickel-cobalt-iron alloy sealing metal. The curve A shows the heat durability of the conventional metal-ceramic sealing terminal. The curve B shows the heat durability of the metal-ceramic sealing terminal of FIG. 4 wherein a constant taper is formed in a thickness from 0.1 mm (tm) at the edge to 0.5 mm over a length l of 3 mm. The data are measured values.

The materials, the structure and the preparation except for the sealing metal shape are the same in both of the metal-ceramic sealing terminals. The heat durability was measured under the same conditions.

Figure 8:
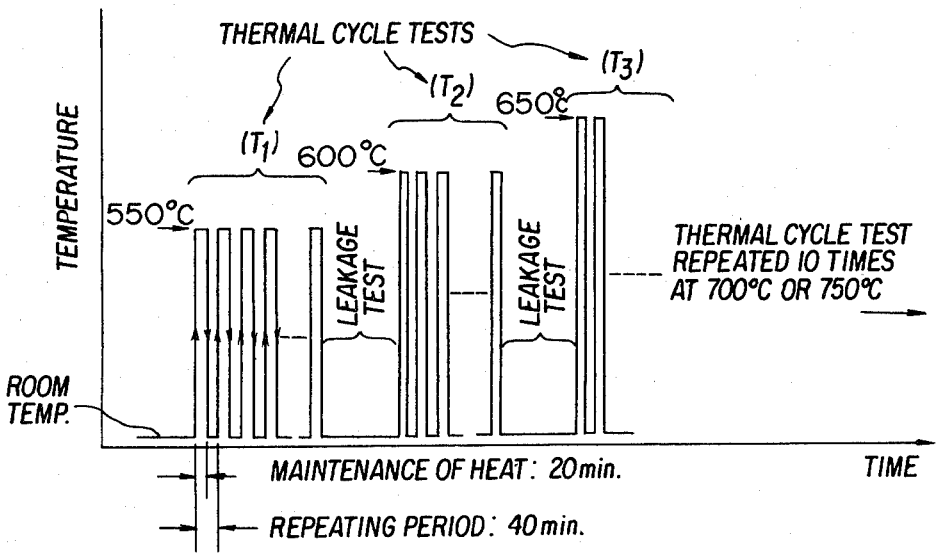
FIG. 8 is a graph showing the operation of the high temperature thermal cycle test.

As shown in FIG. 8, the test was carried out by quickly heating the samples from room temperature to the specific temperature and maintaining them at the specific temperature for 20 minutes and quickly cooling to the room temperature and repeating the thermal cycle for 10 times and carrying out a helium leakage test (less than $10^{-7}$ atm cc/sec.), removing the leaking samples and repeating the thermal cycle tests at higher specific temperatures in the same manner. The number of non-leaking samples after the thermal cycle tests were recorded.

In FIG. 6, the number of non-leaking samples with respect to the temperature are plotted.

As it is clear from the curves A and B, a few samples of the conventional metal-ceramic sealing terminals caused leakage at 700° C. and more than half of the samples caused leakage at 750° C. (curve A) whereas no sample of the sealing terminal of the present invention caused a leakage at 750° C. (curve B).

FIG. 7 shows the data for the samples having the nickel-iron alloy sealing metal which had a larger difference of thermal expansion from that of the alumina ceramic than the samples of FIG. 6. The shape and the test conditions are the same as those of FIG. 6.

Since the sealing metal having a larger difference of thermal expansion from that of the ceramic, is used, the leaking samples are found at lower temperatures in both the conventional sealing terminal (curve A) and the sealing terminal of the present invention (curve B). In comparison between the conventional ones (curve A) and the samples of FIG. 4 (curve B), the latter sealing terminal of FIG. 4 is durable at higher temperatures.

As it is clear from the results, the metal-ceramic sealing means of FIG. 4 has superior high temperature durability to that of the conventional one shown in FIG. 2.

As described, the heat durability of the sealing means can be remarkably improved by tapering the thickness of the sealing part of the cylindrical sealing metal.

The reason is considered as follows.

At the temperature of a large difference of thermal expansion between the ceramic part and the sealing metal part, a plastic-deforming portion and an expansion-contraction elasticity limiting portion can be formed in the portion of the metal sealing part which varies in thickness since the thickness is gradually varied and the thermal stress caused by the thermal expansion can be successively dispersed.

In the sealing structures shown in FIGS. 4 and 5, the brazed part including the outer peripheral part of the ceramic (131) and the inside of the cylindrical sealing metal (132), is of a linear cylindrical shape similar to that of the conventional sealing structure whereby errors of the parts and errors in assembling are not increased in attaining the joint with high accuracy without failure.

Figure 9:
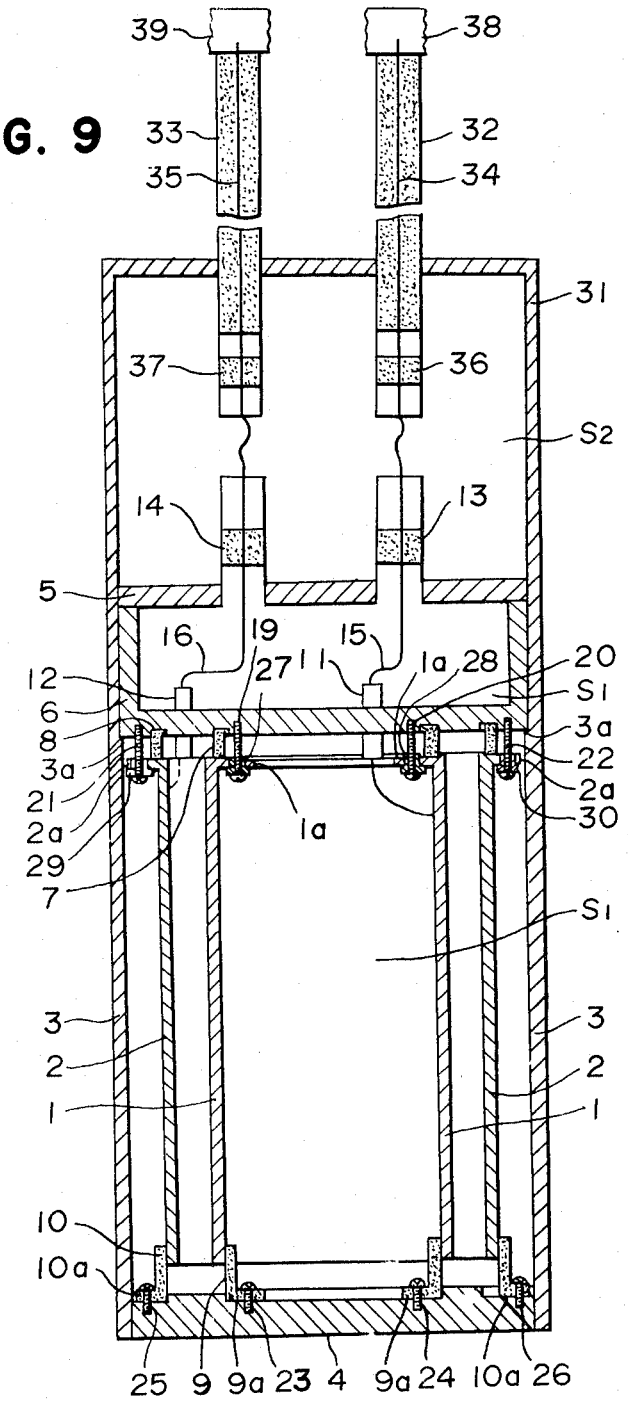
FIG. 9 is a schematic sectional view of the other embodiment of the ionization chamber of the present invention.

FIG. 9 shows another embodiment of the present invention wherein a second outer shell (31) is formed over the top plate (5) whereby the first casing includes an outer shell (3), a bottom plate (4) and a top plate (5) and the second casing includes the outer shell (31), and the top plate (5). The first casing space and the second casing space are identified by the symbols $S_1$ and $S_2$ respectively. A gas having the same or substantially the same pressure of the ionizable gas in the first casing space $S_1$, is filled in the second casing space $S_2$.

The mineral insulated cables (32), (33) which are sheathed with metal penetrate the second outer shell (31) at the end.

The mineral insulated cables (32), (33) comprise copper or stainless steel pipes in which each lead wire (34), (35) is electrically insulated by a filling of inorganic insulated powder such as magnesia in high density. They are called MI cables.

Connectors (38), (39) are connected at the outer edges of the mineral insulated cables (32), (33). On the other hand, the belowmentioned terminals (36), (37) having a sealed structure are connected at the inner edges of the mineral insulating cables.

Figure 10:
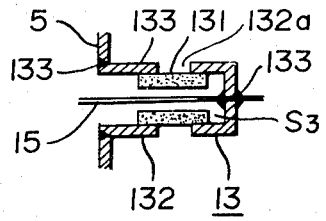
FIG. 10 is a sectional view of the output terminal of the ionization chamber of FIG. 9.

The output terminals (13), (14) and the terminals (36), (37) will be illustrated. The output terminal (13) (the output terminal (14) has the same structure) comprises a sealing metal part (132) having a side opening (132*a*) and a sealing ceramic piece (131) for closing the opening (132*a*) from the inside of the sealing metal part (132) as shown in FIG. 10. The sealing metal part (132), the ceramic piece (131), the lead wire (15) and the top plate (5) are respectively bonded in an air-tight manner to the bonding part (133). The inner space $S_3$ of the sealing metal (132) is in fluidic communication with the first casing.

Figure 11:
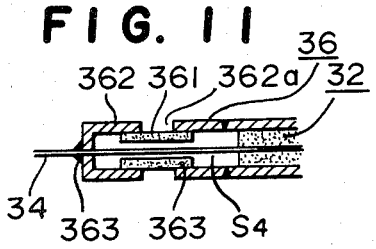
FIG. 11 is a sectional view of a sealing terminal structure of the inner edge of a mineral insulation cable used in the ionization chamber of FIG. 9.

On the other hand, the terminal (36) of the mineral insulated cable (32) (the same as the terminal (37) of the mineral insulated cable (33)) comprises a sealing metal part (362) having an opening (362*a*) and a sealing ceramic piece (361) as shown in FIG. 11 which is similar to the structure of the output terminal (13), (14). A pressurized gas is filled in the inner space $S_4$ of the sealing metal (132) so as to be substantially the same pressure as in the spaces $S_1$, $S_2$.

In the ionization chamber having said structure, the coaxially arranged cylindrical electrodes (1), (2) are held in the casing so as to allow axial shifting of the edges of the electrodes but to prevent radial shifting of the electrodes. Therefore, the decrease of the pushing force caused by relaxation of springs can be prevented and the looseness is not caused whereby the characteristics are stable.

When the pressure of the gas filled in the second casing $S_2$ is substantially the same as the pressure of the ionizable gas in the first casing $S_1$, even though the pressure of the ionizable gas in the first casing $S_1$ is remarkably increased, the pressure of the gas in the second casing $S_2$ is increased for the same level.

Since the inner space $S_3$ of the cylindrical sealing metal (132) of the output terminal (13) (or the terminal (14)) is communicated to the inner space $S_1$ of the first casing whereby the pressure difference applied on the inner and outer surfaces of the output terminal (13) (or the terminal (14)) of the metal-ceramic sealing means is maintained to zero or substantially zero. Therefore, there is no damage of breaking by pressure even though the pressure withstand strength of the output terminals (13), (14) is decreased at high temperature.

In said structure, the pressure of the ionizable gas can be increased as desired only by increasing the pressure withstand strength of the first and second casings, regardless of the pressure withstand strength of the sealing terminals.

In said pressurized condition, only the sealing property is required for the metal-ceramic sealing means but the pressure durability at high temperature is not important. Therefore, the thickness of the sealing metal can be relatively thin or a soft metal substance such as copper can be used. Moreover, the sealing property between the metal and the ceramic can be further improved by utilizing the expansion-contraction property.

On the other hand, the inner edges of the mineral insulated cables (32), (33) have the sealing structure as shown in FIG. 11, whereby there is no problem of shortcircuiting of the core wire to the outer tube by gradually moving the powdery insulator such as magnesia filled in the mineral insulating cables (32), (33) in high density, into the second casing $S_2$.

The gas is filled in the space $S_4$ of the mineral insulated cables (32), (33) so as to be the same pressure of the space $S_2$ of the second casing. Therefore, the stable sealing property at high temperature can be maintained as in the above-mentioned principle.

The stability of the sealing terminals is shown as follows.

When both of the output terminals (13), (14) and the inner edges of the mineral insulated cables (32), (33) are in the sealing structure as shown in FIG. 9, the stability of the metal-ceramic sealing terminals could be maintained as shown in FIGS. 7 and 8 at high temperature of about 700° C. and high pressure of 25 atm. and the ionization chamber has stable function.

What is claimed is:

1. In an ionization chamber comprising a plurality of coaxially arranged cylindrical electrodes and a casing containing an ionizable gas which holds said cylindrical electrodes, and an output terminal for transmitting electric signals through said casing, an improvement wherein said cylindrical electrodes are held in said casing so as to allow axial shifting of the edges of said electrodes but to prevent radial shifting of said electrodes; wherein said output terminal is formed by metal-ceramic sealing means which includes a cylindrical sealing metal part bonded on an outer surface of a cylindrical ceramic part; and wherein the outer surface of said cylindrical sealing metal part is formed to have a tapered portion whose thickness is gradually decreased to an edge of said sealing metal part; whereby thermal stresses within said output terminal are minimized.

2. An ionization chamber according to claim 1 wherein an axial length of said tapered portion of said output terminal is more than two times a maximum thickness of said sealing metal part and wherein a thickness of the edge of said tapered portion is less than $\frac{1}{2}$ of the maximum thickness of said tapered portion.

3. In an ionization chamber comprising a plurality of coaxially arranged cylindrical electrodes and a first casing containing an ionizable gas, an output terminal made of metal-ceramic sealing means passing through said first casing for transmitting electric signals through said casing, and a second casing which covers at least a portion of said output terminal and at least a portion of said first casing, an improvement wherein said cylindrical electrodes are held in said first casing so as to allow axial shifting of the edges of said electrodes but to prevent radial shifting of said electrodes and said second casing is filled with a gas at a pressure substantially the same as the pressure of an ionizable gas filling said first casing.

4. An ionization chamber according to claim 3 wherein metal-ceramic sealing means is connected to an edge of a metal coated mineral insulating cable exposed in said second casing and a gas is filled in the inner space of said metal-ceramic sealing means in the cable side at a pressure substantially the same as the pressure of the gas filling said second casing.

5. An ionization chamber comprising:

inner and outer cylindrical electrodes arranged coaxially;

a sealed casing containing an ionizable gas within which said inner and outer cylindrical electrodes are disposed;

means disposed within said casing for securing said inner and outer electrodes within said casing such that at least one axial end surface portion of each of said inner and outer electrodes is free from axial contact with and axial restraint from said securing means and for allowing substantially free unimpeded axial movement of said at least one end surface portion and such that radial shifting of said inner and outer electrodes is prevented by said securing means.

6. An ionization chamber according to claim 5 wherein said casing comprises:

a cylindrical shell coaxially arranged with said cylindrical electrodes and having first and second openings formed at both axial edge portions thereof; and first and second edge plates for closing said first and second openings.

7. An ionization chamber according to claim 6 wherein said inner and outer coaxially arranged cylindrical electrodes each have a free edge portion facing and axially displaced a predetermined distance from said first edge plate of said casing and a stationary edge portion axially fixed to said second edge plate of said casing.

8. An ionization chamber according to claim 7 wherein said free edge portion of said inner and outer cylindrical electrodes is slidably contacted with first and second cylindrical guides, respectively, fixed to said first edge plate of said casing and wherein said stationary edge portion of said inner and outer electrodes further comprises first and second integral collars formed thereon, respectively, for fixing said stationary edge on said second edge plate.

* * * * *

UNITED STATES PATENT AND TRADEMARK OFFICE

CERTIFICATE OF CORRECTION

PATENT NO. : 4,379,248

DATED : April 5, 1983

INVENTOR(S) : Naoaki Wakayama et al.

It is certified that error appears in the above-identified patent and that said Letters Patent is hereby corrected as shown below:

On the title page Item [75] should read:

[75] --Inventors: Naoaki Wakayama, Tohkaimura; Hideshi Yamagishi, Mito; Toshimasa Tomoda; Hiroji Tanaka, both of Amagasaki, all of Japan. --

Signed and Sealed this

*Twenty-fourth* Day of *May 1983*

[SEAL]

*Attest:*

DONALD J. QUIGG

*Attesting Officer*

*Acting Commissioner of Patents and Trademarks*